US006666393B2

(12) United States Patent
Weir

(10) Patent No.: US 6,666,393 B2
(45) Date of Patent: Dec. 23, 2003

(54) APPARATUS FOR BREAKING UP COMPACTED LAUNDRY

(76) Inventor: Henry John Weir, The Willows, Woodcroft Close, Chepstow NP6 7HX (GB)

( * ) Notice: Subject to any disclaimer, the term of this patent is extended or adjusted under 35 U.S.C. 154(b) by 37 days.

(21) Appl. No.: 09/774,535

(22) Filed: Jan. 31, 2001

(65) Prior Publication Data

US 2001/0020658 A1 Sep. 13, 2001

(30) Foreign Application Priority Data

Feb. 4, 2000 (GB) ..... 0002458

(51) Int. Cl.[7] ..... B02C 19/12

(52) U.S. Cl. ..... 241/30; 241/223; 241/235; 241/266

(58) Field of Search ..... 241/235, 159, 241/224, 223, 100, 266, 30; 100/37, 264; 68/22 R, 244, 245, 112

(56) References Cited

U.S. PATENT DOCUMENTS

| | | | | | |
|---|---|---|---|---|---|
| 110,346 | A | * | 12/1870 | Desgoffe | 100/264 |
| 1,062,465 | A | * | 5/1913 | Hill | 100/264 |
| 3,603,122 | A | * | 9/1971 | Sulzmann | 100/121 |
| 3,964,718 | A | * | 6/1976 | Balistrieri | 241/159 |
| 4,306,495 | A | | 12/1981 | Grantham | |
| 4,676,154 | A | * | 6/1987 | Steinort | 100/116 |

FOREIGN PATENT DOCUMENTS

| | | |
|---|---|---|
| EP | 0 600 671 A1 | 6/1994 |
| EP | 0 743 390 A1 | 11/1996 |

* cited by examiner

*Primary Examiner*—Mark Rosenbaum
(74) *Attorney, Agent, or Firm*—Brinks Hofer Gilson & Lione

(57) ABSTRACT

There is provided apparatus for breaking up a cake 5 of compacted laundry. The cake 5 falls from a conveyor 6 into the nip between a pair of spaced star shaped rollers 1 mounted on a frame 2 and driven by a motor and gearing 3. The broken up articles of laundry fall into a transporting means 8 provided below the rollers 1.

16 Claims, 9 Drawing Sheets

APPARATUS FOR BREAKING UP COMPACTED LAUNDRY

This application claims the benefit of foreign priority pursuant to 35 U.S.C. §§119 to British Patent Application No. 0002458.8, filed Feb. 4, 2000, the disclosure of which is incorporated herein by reference.

BACKGROUND

The invention relates to means for breaking up heavily compacted batches of laundry after the water extraction process. Continuous batch washing machines are employed by many commercial laundries to process their workloads. On completion of the washing and rinsing cycles these machines automatically discharge a batch of water laden laundry into a water extraction press which is arranged to apply considerable pressure upon the laundry to squeeze out most of its water content. After the pressing operation the load is automatically discharged from the press in the form of a very compacted circular cake. These cakes of laundry are discharged from the press at intervals of approximately two to four minutes onto a storage conveyor which progresses each load in a series of stop and start movements thereby spacing them along the conveyor run which directs them onward to the further processing stages.

Due to the very compressed structure of these cakes they do need to be broken apart into a condition where they are easier to handle. This operation is usually performed by a rotary tumbler into which the cake is loaded. Most commercial laundries employ conveyor systems which convey the cakes from the water extraction press and automatically feed them directly into heated tumblers, after a pre-set run cycle the broken up work load is discharged from the tumbler into mobile containers or onto conveyors for onward processing. The tumbler into mobile containers or onto conveyors for onward processing. The tumblers will impart some further drying action on the load of laundry, however most work loads will eventually be processed through multi roller ironing equipment which will iron it and also dry out the remaining residual moisture. The rotary action of the tumbler whilst breaking up the compressed cake can cause severe tangling of the separated articles making the handling operations more difficult.

In some laundries the tumblers are manually loaded which requires some effort on the part of the loading operators to partially break up the compressed cake in order to perform the loading operation.

SUMMARY

The object of the invention is to provide means which will break up the compressed structure of a cake of laundry after it has been discharged from the water extraction press and convey it onward in an easier to handle condition direct to the feeding and ironing equipment for final processing thereby eliminating the time consuming and more expensive tumbler processing operation.

According to the invention means are provided which will apply powerful forces on the sides of the circular cake of laundry which has the effect of breaking up the compressed layers of fabric due to the forces being directed in the opposite direction to the forces of the water extraction press which originally formed the compacted cake. In order to maintain an uninterrupted throughput flow of laundry it is desirable for the compressed cakes to be broken apart during their conveying operation from the water extraction press and discharged into mobile laundry trucks or onto conveyors for further processing.

DETAILED DESCRIPTION OF THE PREFERRED EMBODIMENTS

Figure 1:
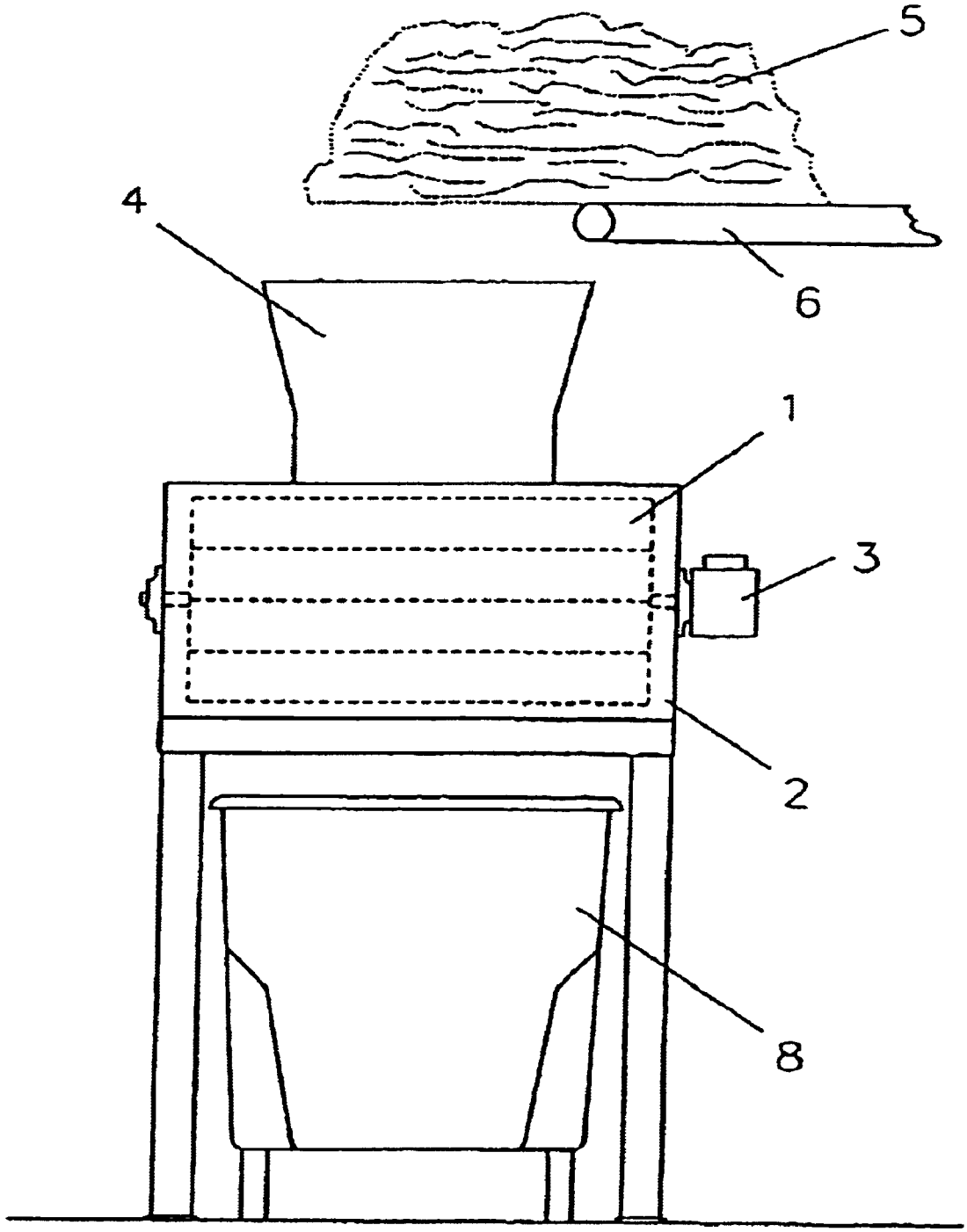
FIGS. 1 and 2 are front views of one embodiment of an apparatus for breaking up compacted laundry.
Figure 2:
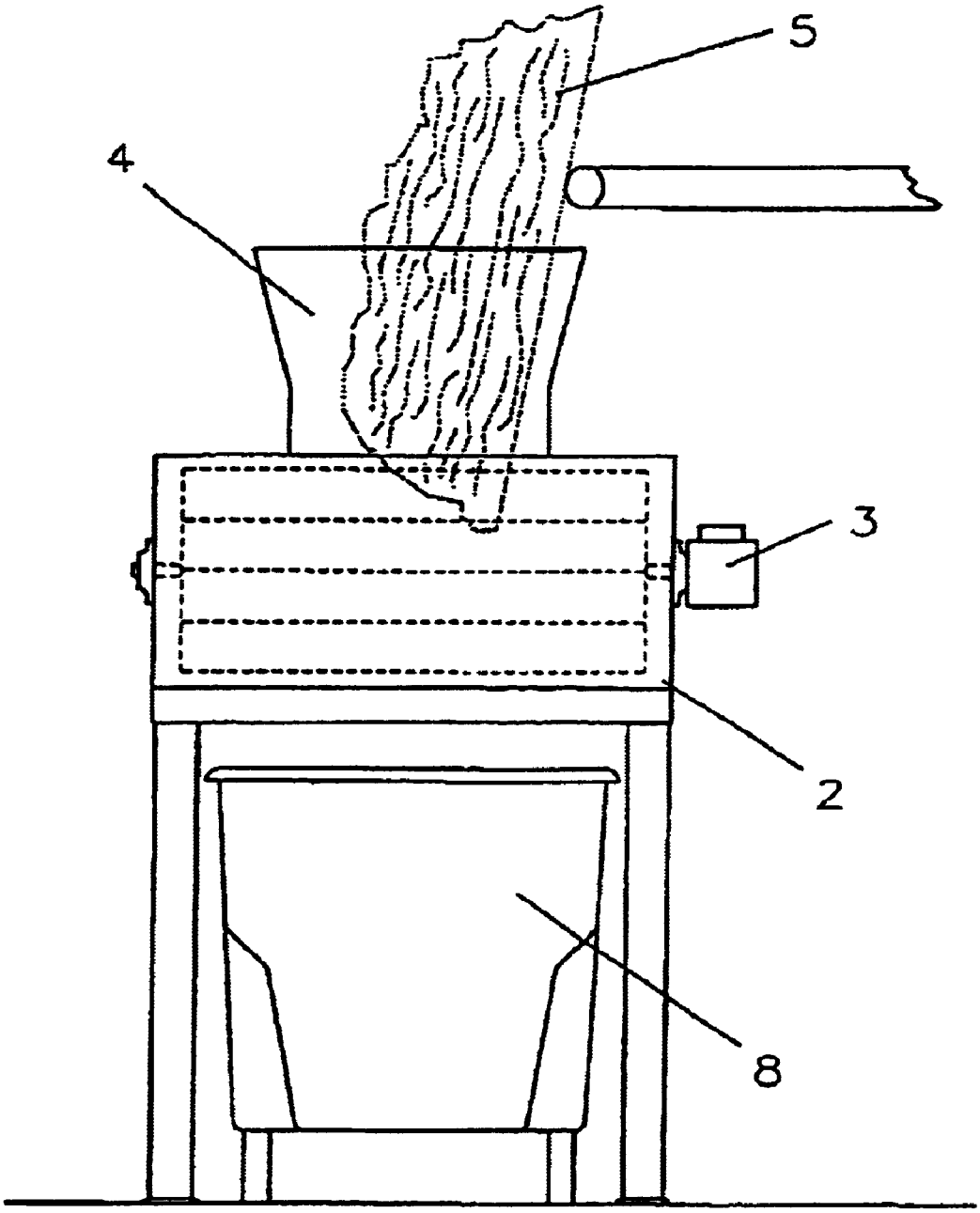
Figure 3:
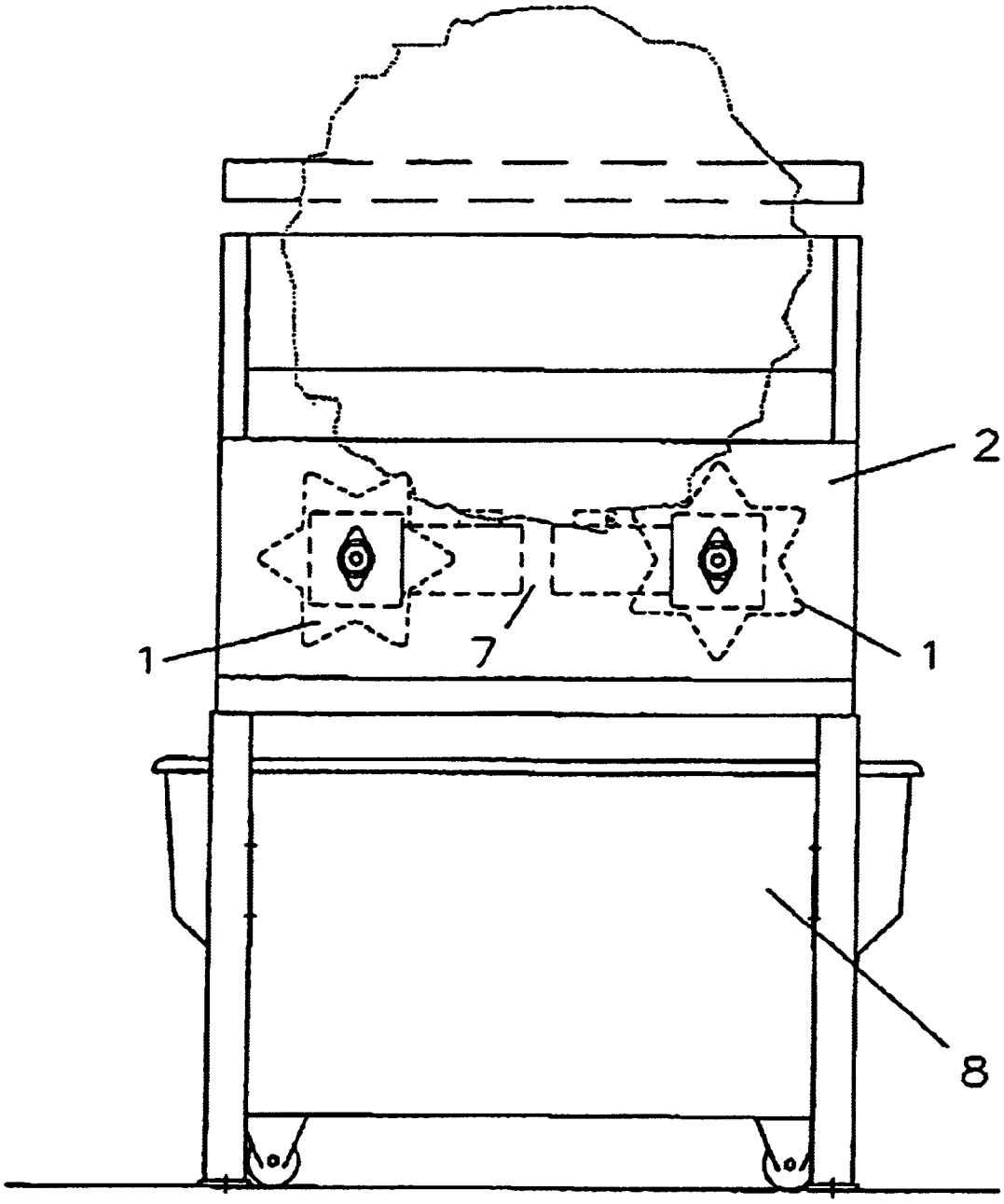
FIGS. 3, 4 and 7 are side views of one embodiment of a structure for breaking compacted laundry.
Figure 4:
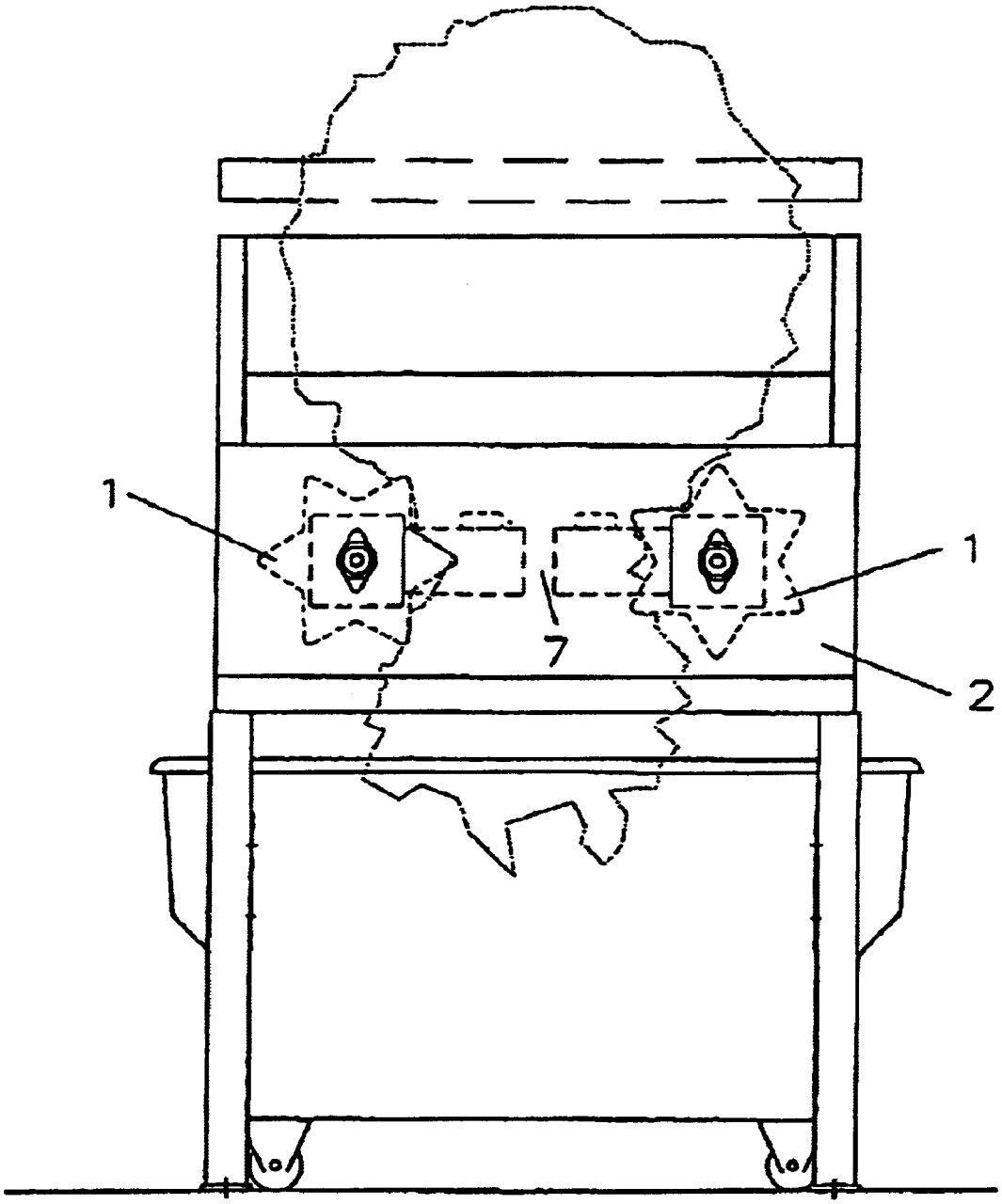

In its preferred form the invention comprises a pair of six pointed star shaped rollers suitably spaced apart and slowly rotated in opposing directions. The compressed cake of laundry is directed by the conveyor system so that the sides of the cake will engage in the nip space between the rollers, as the load is drawn into the narrow gap high pressure forces are exerted upon the sides of the cake which destroy its structure. After passing through the rollers the load is arranged to fall downwards into a mobile truck or onto a conveyor; preferably the discharge point from between the rollers is located at an elevated height above the receiving truck or conveyor as the addition of a gravity drop will improve the further break up of the cake.

The preferred embodiment of the invention as shown in FIGS. 1, 2, 3 and 4 will now be described:

A pair of star shaped rollers 1 located in a spaced apart horizontal position in a suitable box shaped frame 2 are slowly rotated by way of the required motor and gearing 3. A hopper 4 is arranged on top of the frame into which a cake 5 will fall at the end of the cake conveyor run 6 where it is directed to engage in the nip space 7 between the rollers which crush it as it passes through finally dropping the load into transporting means 8 situated below.

Figure 5:
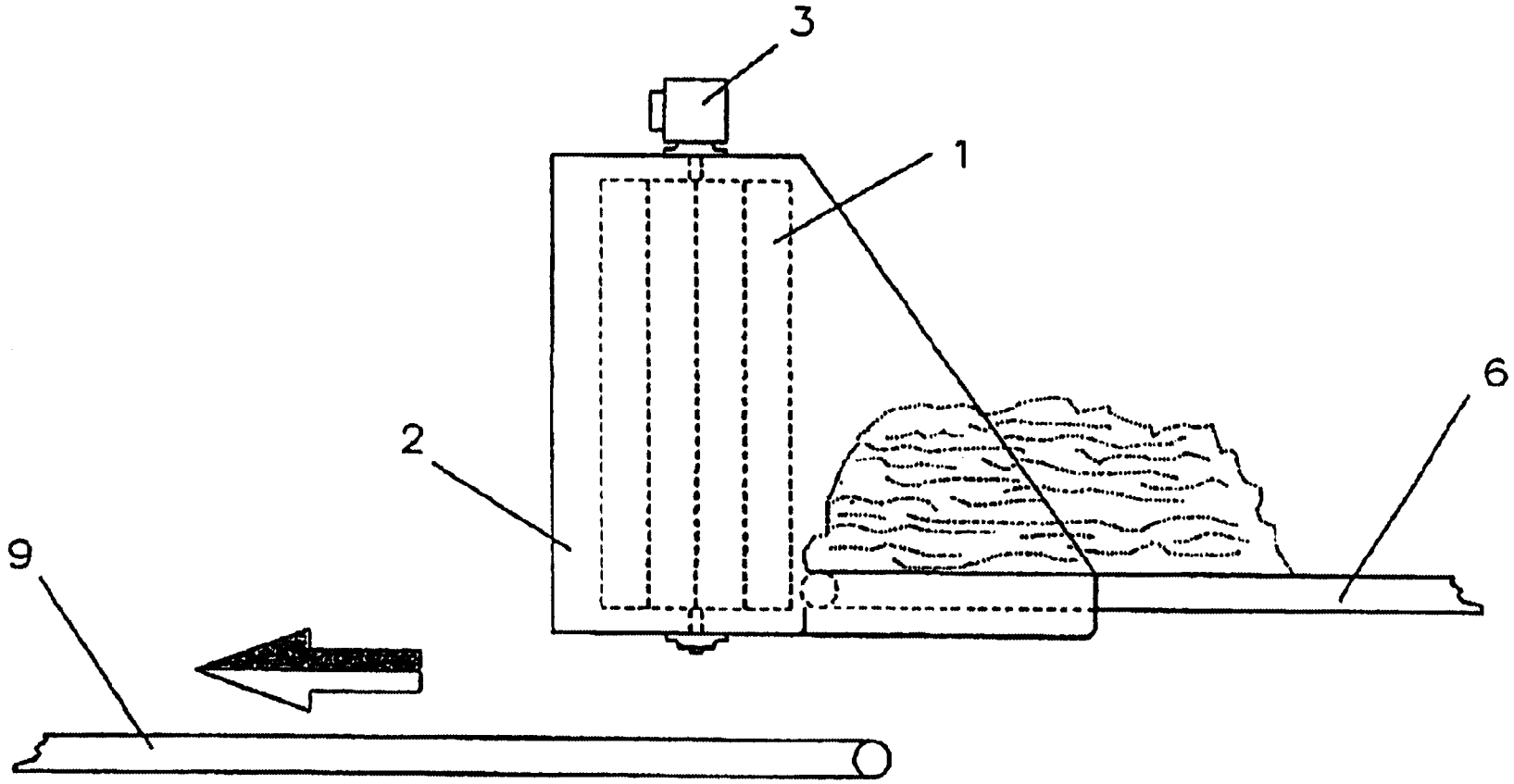
FIGS. 5, 6 and 8–10 are views of other embodiments of structures for breaking compacted laundry.
Figure 6:
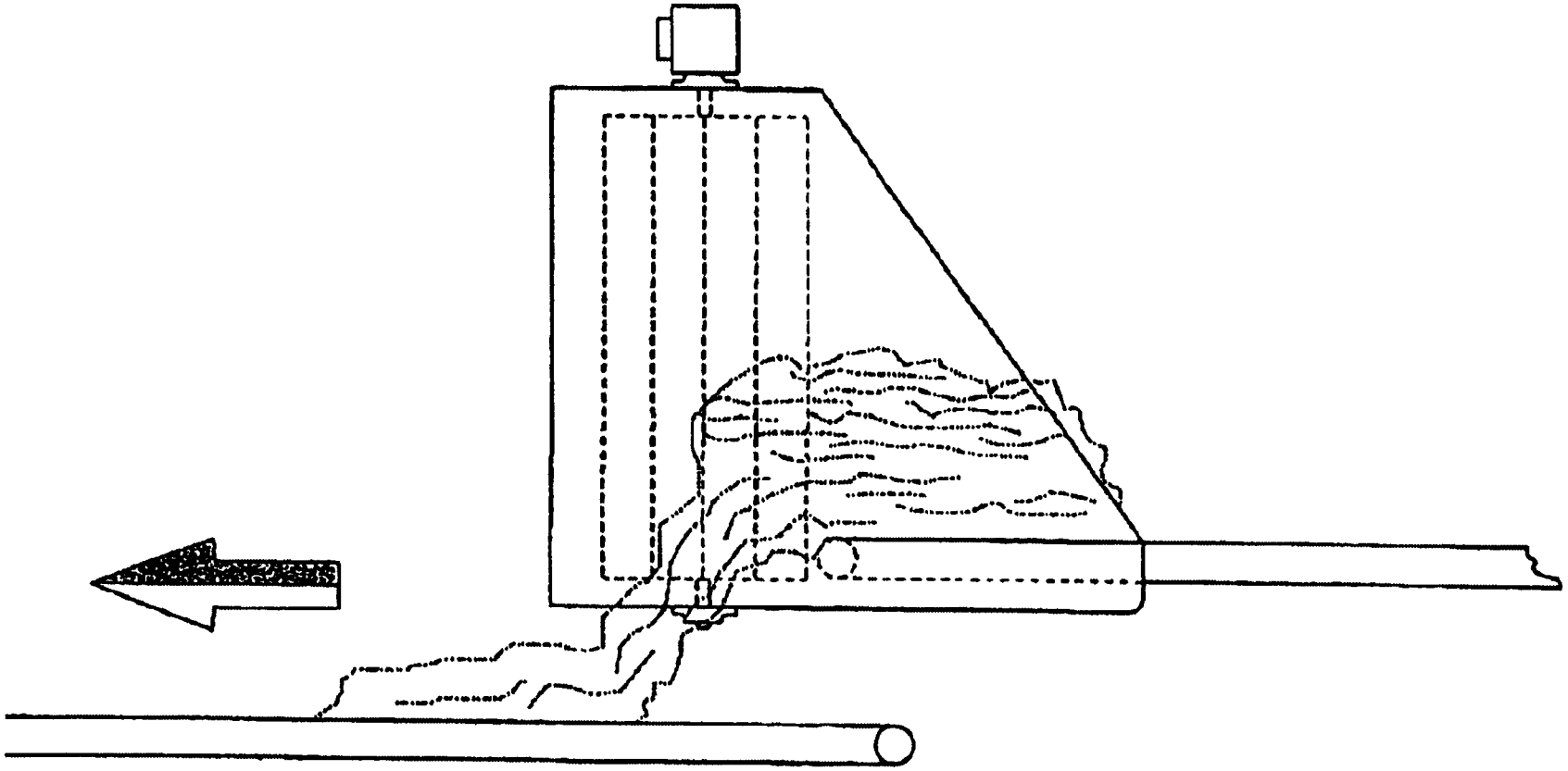
Figure 7:
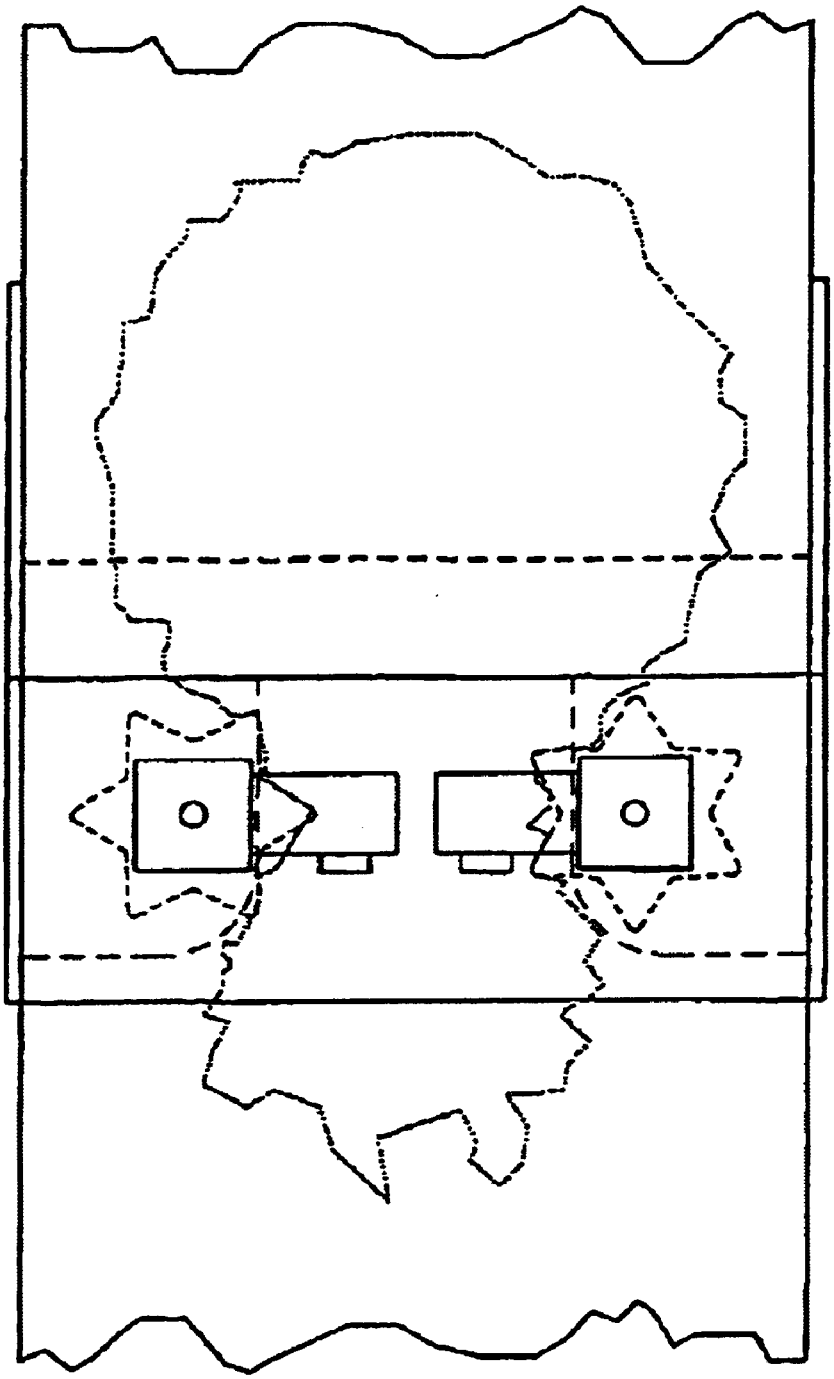

The roller arrangement described above can also be positioned vertically as shown in FIGS. 5, 6 and 7. The compressed cake is conveyed directly into the nip space 7 of the crushing rollers by conveyor 6 and the broken up load deposited onto conveyor means 9 for onward processing.

Figure 8:
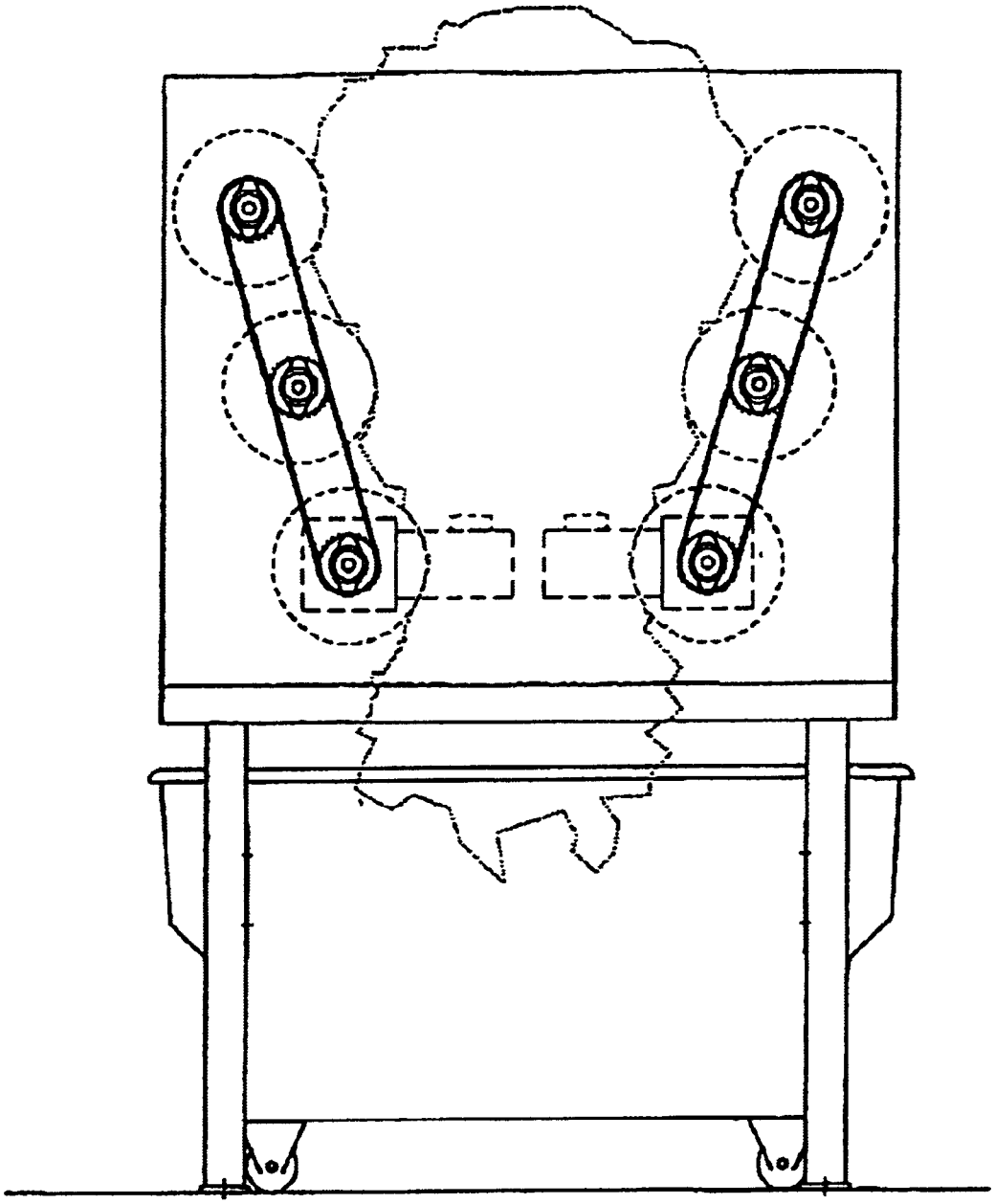

Other alternative means can be employed to apply the required thrust forces on the side walls of the cake to break up its compacted structure:

FIG. 8 shows an arrangement where the cake is directed through a series of power driven plain rollers suitably spaced with a wide gap at the engagement point progressively reducing to a narrow gap at the final discharge point.

Figure 9:
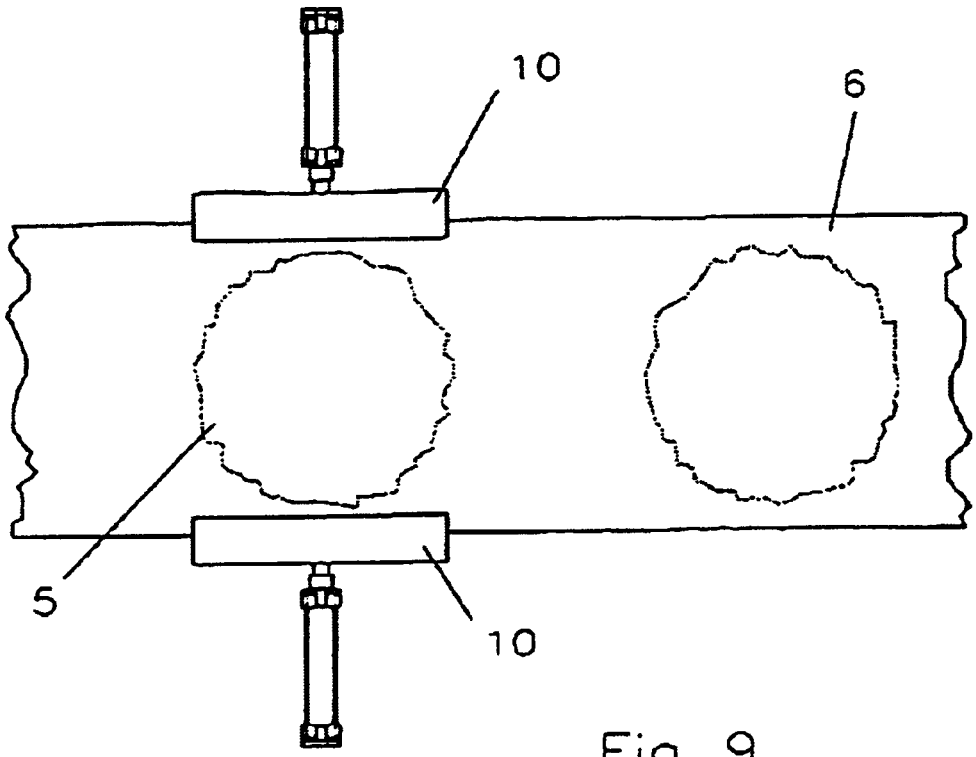
Figure 10:
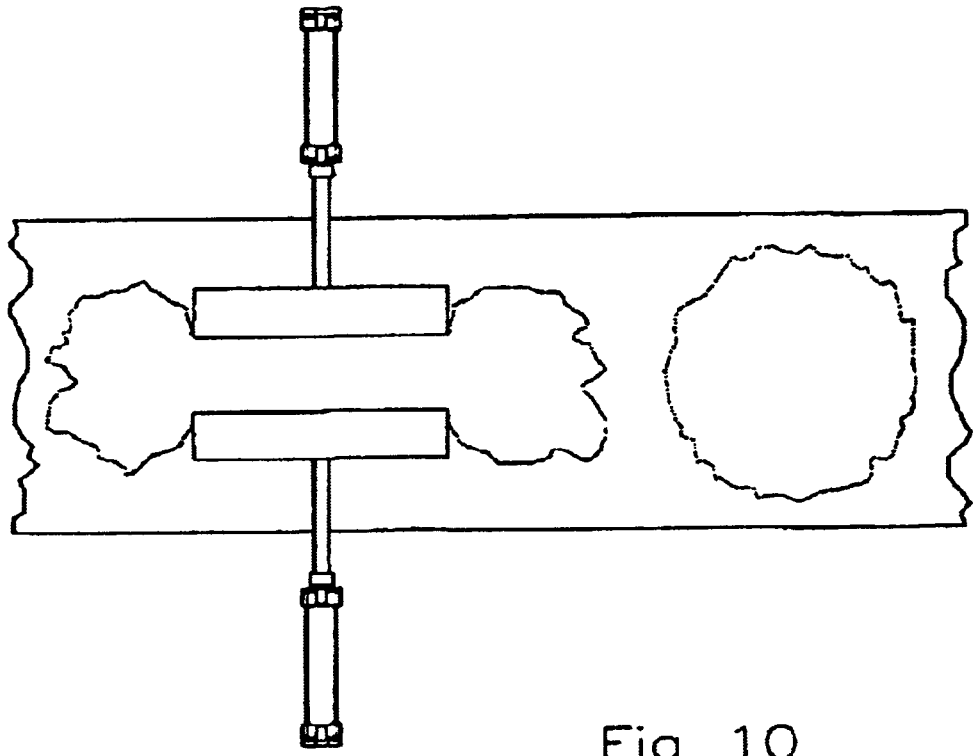

FIGS. 9 and 10 show a plan schematic arrangement employing a pair of spaced apart press plates 10 which are powered by either mechanical or fluid means to move inward and apply the crushing force on the side walls of the cake 5. These plates are located on each side of conveyor run 6 and are arranged to move over the upper surface of the conveyor belt. The conveyor is stopped when a cake is moved into position between the press plates which are then powered inward to apply the required forces on the sides of the cake, they are then moved apart to permit the load to be onward conveyed.

Both of the above mentioned arrangements are more complex and less cost effective than the star shaped roller system. For manufacturing expediency the six-pointed star shaped roller is preferred, it should be noted however that other forms of roller shapes would also be effective.

What is claimed is:

1. Apparatus for breaking up a compacted cake of laundry comprising a pair of spaced apart rollers driven in rotation in opposing directions and defining a nip there between, the lengthwise axes of the rollers being generally parallel to the pressing forces which originally formed the cake so that the forces relative to the cake are generally transverse to the pressing forces which originally formed the cake;

wherein a shape of the rollers in transverse cross-section is non-circular.

2. Apparatus as claimed in claim 1 wherein a plurality of pairs of spaced rollers are arranged in series, the distance between the rollers of each pair decreasing.

3. Apparatus as claimed in claim 1 wherein the rollers are mounted on a frame below a feed hopper, the lengthwise axes of the rollers being generally horizontal and there being space below the rollers into which space the broken up laundry drops.

4. Apparatus as claimed in claim 3 wherein the space below the rollers can be occupied by a wheeled truck or an onward conveyor.

5. Apparatus as claimed in claim 4 further comprising a belt conveyor positioned above the feed hopper to direct the cake to engage the nip so that the lengthwise axes of the rollers are generally parallel to the pressing forces which originally formed the cake.

6. Apparatus as claimed in claim 1 wherein there is provided a feeder for presenting the cakes to the force applying means, the lengthwise axes of the rollers being generally vertical on opposite sides of the feeder.

7. Apparatus for breaking up a compacted cake of laundry comprising a pair of spaced rollers driven in rotation in opposing directions and defining a nip there between for applying forces to the cake, the forces relative to the cake being generally transverse to the pressing forces which originally formed the cake, the lengthwise axes of the rollers being generally parallel to the pressing forces which originally formed the cake;

wherein the rollers are star-shaped in transverse cross-section.

8. Apparatus as claimed in claim 7 wherein the rollers are six-pointed star shape in transverse cross-section.

9. An apparatus for breaking a compacted cake of laundry, the apparatus comprising;

a frame;

a pair of non-contacting rollers, wherein the rollers are mounted on the frame such that a cake input and a laundry output are formed;

a motor connected to at least one of the non-contacting rollers;

a conveyor disposed to provide a cake of laundry from a water extraction press to a position between the non-contacting rollers, the conveyor operable to hold the cake such that an axis along which the pressing force which originally formed the cake in the water extraction press is substantially perpendicular to the conveyor and the conveyor positioned relative to the pair of non-contacting rollers such that the non-contacting rollers apply force to the cake transverse to the pressing force which originally formed the cake, lengthwise axes of the rollers being substantially parallel to the axis along which the pressing force originally formed the cake and the lengthwise axes of the rollers being substantially perpendicular to an end of the conveyor.

10. The apparatus of claim 9 wherein the non-contacting rollers are non-circular in transverse cross-section.

11. Apparatus for breaking up a compacted cake of laundry comprising:

a pair of oppositely disposed press plates, which are movable towards each other to engage the compacted cake for applying forces to the compacted cake, the pair of press plates positioned relative to the compacted cake of laundry such that the forces are generally transverse to the pressing forces which originally formed the cake; and a conveyor disposed to provide the compacted cake of laundry from a water extraction press to a position between the press plates, the conveyor operable to hold the cake such that an axis along which the pressing force which originally formed the cake in the water extraction press is substantially perpendicular to the conveyor and the conveyor positioned relative to the press plates such that the press plates are operable to apply force to the cake transverse to the pressing force which originally formed the cake, the movement of the press plates towards each other being along an axis that is substantially perpendicular to the axis along which the pressing force originally formed the cake and being generally parallel to and above a surface of the conveyor operable to support the compacted cake.

12. A method for breaking up a compacted cake of laundry, the method comprising the acts of:

(a) conveying a cake of compressed laundry from a water extraction press, the cake having an axis along which pressing forces originally formed the cake; and (b) applying forces transverse to the axis along which pressing forces originally formed the cake.

13. The method of claim 12, wherein the cake has sides parallel to the axis, and (b) comprises passing the cake between spaced apart rollers with the sides of the cake in contact with the rollers.

14. The method of claim 13 wherein (b) comprises rotating the rollers.

15. The method of claim 12 wherein the cake has sides parallel to the axis, and (b) comprises applying the forces to the sides of the cake with at least two plates.

16. The method of claim 15 wherein (b) comprises moving the two plates against the sides of the cake.

* * * * *